United States Patent [19]

Riniker

[11] 4,131,991

[45] Jan. 2, 1979

[54] METHOD OF MAKING FLEXIBLE PRESSURE SENSITIVE SWITCH

[75] Inventor: James P. Riniker, Sparta, Wis.

[73] Assignee: Northern Engraving Company, Inc., Sparta, Wis.

[21] Appl. No.: 796,002

[22] Filed: May 11, 1977

Related U.S. Application Data

[62] Division of Ser. No. 620,955, Oct. 9, 1975, Pat. No. 4,035,593.

[51] Int. Cl.[2] ..... H01H 11/00

[52] U.S. Cl. ..... 29/622; 29/625; 156/277; 156/300

[58] Field of Search ..... 29/622, 625; 200/5 R, 200/5 A, 159 B, 308, 314, 317, 86 R, 293–296, 329, 340; 428/40; 174/68.5; 156/300, 277

[56] References Cited

U.S. PATENT DOCUMENTS

| | | | |
|---|---|---|---|
| B 579,104 | 1/1976 | Demler, Jr. | 29/622 X |
| 3,538,389 | 11/1970 | Levesque | 174/68.5 X |
| 3,627,927 | 12/1971 | Schmitz et al. | 200/5 A UX |
| 3,718,791 | 2/1973 | Szablowski | 200/86 R X |
| 3,732,389 | 5/1973 | Kaelin et al. | 200/5 A X |
| 3,886,012 | 5/1975 | Slater | 200/5 A X |

*Primary Examiner*—Victor A. DiPalma
*Attorney, Agent, or Firm*—Norman Lettvin; Gerald S. Geren

[57] ABSTRACT

A flexible, self-biasing switching element is disclosed herein for closing a circuit by flexing the element from an initial non-contacting position to a second contacting position and for opening the circuit by releasing the element and permitting it to return to a non-contacting position from the contacting position. The element includes a flexible non-conductive substrate having on one side thereof a plurality of spaced conductive contacts or areas. A two-sided pressure sensitive adhesive film for mounting the element is die cut and applied to the substrate in a manner so as to surround the conductive contact areas. The adhesive film provides an insulating medium between the contact points so as to prevent transmission of current between the contact points.

4 Claims, 3 Drawing Figures

METHOD OF MAKING FLEXIBLE PRESSURE SENSITIVE SWITCH

This is a division of application Ser. No. 620,955, now U.S. Pat. No. 4,075,593 filed Oct. 9, 1975.

BACKGROUND OF THE INVENTION

This invention relates to electrical switching elements, and more particularly, to a flexible electrical switching element.

In many situations it is desirable to provide a decorative and reliable switching element which can be applied to flat surfaces, such as a dashboard or telephone base. Mechanical switches are well known but do not provide the desired appearance and may be unreliable in that dirt can cause clogging of the switching mechanism.

Moreover, in most applications it is desirable that the element be of simple design and inexpensive to manufacture.

It is therefore an object of this invention to provide a decorative and reliable switching element which is of simple design and inexpensive to manufacture.

These and other objects will become apparent from the following description and appended claims.

SUMMARY OF THE INVENTION

There is provided by this invention a flat, decorative, one-piece switching element which meets the foregoing objects. The element includes a flexible substrate having electrical contact areas thereon which are aligned in cooperative relationship with indicia on the substrate. The indicia provides information as to the circuits activated by pressing the indicia. The substrate is of a flexible, non-conducting material and the contact areas are of silver. A combination insulator and bonding agent is applied to the substrate for separating the contact areas so as to prevent electrical communication between the contact areas and for mounting the switching element to the desired surface.

DESCRIPTION OF THE PREFERRED EMBODIMENT

Figure 1:
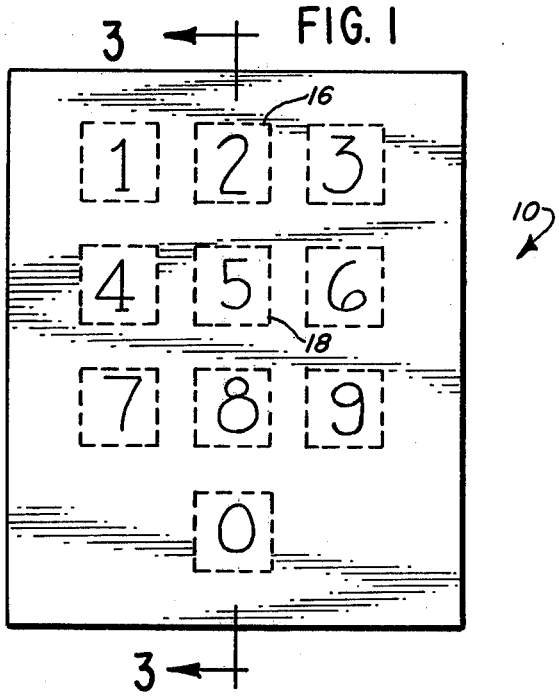
FIG. 1 is a front view of a switching element.
Figure 2:
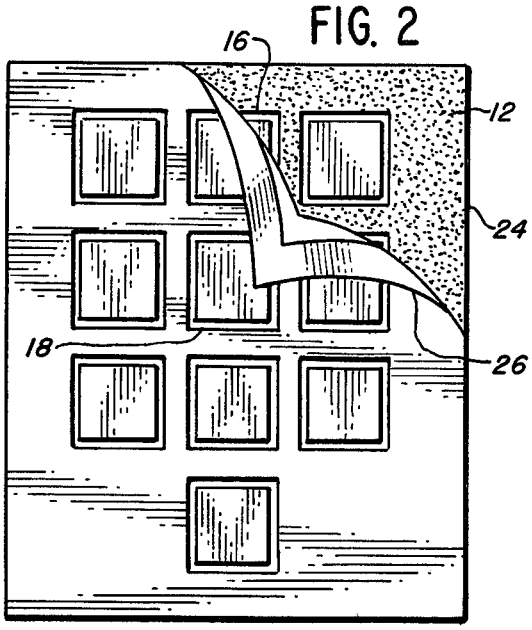
FIG. 2 is a back view of a switching element with portions of the element peeled back.
Figure 3:
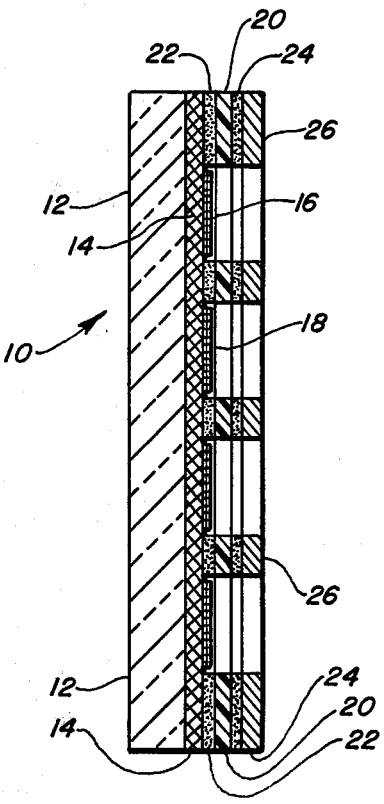
FIG. 3 is a greatly enlarged cross-sectional view taken substantially along line 3—3 showing the various layers of the switching element.

Referring now to the drawings, there is shown a switching element 10 generally, which has ten separate switching areas designated by the numerals 0–9, inclusive, The element 10 includes a flexible, non-conducting plastic substrate 12, such as Mylar, which is preferably transparent. A decorative ink flim 14 is printed on one side of the substrate 12 and it includes the numerals 0–9.

Silver contact areas, such as 16 and 18, are printed on the decorative film 14 in alignment with the numerals, such as numbers 2 and 5. The contact areas, such as 16 and 18, are spaced from one another and are adapted to contact and complete electrical circuits (not shown).

A two-sided pressure sensitive adhesive film, which includes a central Mylar sheet 20 approximately 0.001 inches thick having adhesive 22 and 24 on either side and a paper release layer 26, is die cut so as to provide apertures or openings that can be aligned with the silver contact areas.

The die-cut pressure sensitive adhesive film and paper release layer are applied to the printed film so as to expose the silver contact area in the apertures formed in the release layer and adhesive layer. The adhesive and Mylar cooperate in insulating and isolating the contact areas from each other and for preventing transient electrical currents from communicating between the respective contact areas.

The substrate coupled with the adhesive and Mylar layer is flexible and resilient so that any one of the contact areas can be pressed to complete the appropriate circuit and when released pops or snaps back to the initial non-contacting position.

This particular switching element is inexpensive to manufacture in that it is capable of being manufactured by a printing process. In such a process, the substrate 12 is passed through an appropriate printing roll so as to apply the ink film 14. Passing the already printed substrate to another set of printing roll can apply the silver contact areas 16 and 18. Then the die-cut pressure sensitive adhesive and release layer can be also applied.

As can be seen from the foregoing, this switching element is an one-piece construction which combines the features of low manufacturing cost, simplicity of manufacture and reliability.

The switching element 10 can be used in many applications. For example, the contacts can be used in a normal telephone system where the two contact points are positioned under the respective numerals. Upon depressing of the numeral, for example 5, the circuit thereunder would be closed so as to provide the necessary communication of information to the telephone switching circuit. Release of the 5 reopens the circuit and then the next in the series of numbers could be depressed. Similarly, the element could be used in other applications where a flat surface is generally desirable.

It will be appreciated that numerous changes and modifications can be made to the embodiment disclosed herein without departing from the spirit and scope of this invention.

I claim:

1. A method for manufacturing a unitary, self-biasing and flexible switching element which includes a flexible and electrically non-conductive substrate, a plurality of electrically conductive contact area means carried by the substrate, indicia carried by said substrate and in aligned relation to said contact area means so as to indicate individual contact areas which may be activated, and apertured insulating and bonding means carried by said substrate and in surrounding relationship with each of said contact area means, said method including the steps of:

providing flexible and electrically non-conductive substrate;

printing said contact area means on one side of said substrate with silver; and applying said apertured insulating and bonding means to the same side of said substrate as said contact area means and in surrounding relationship to said contact area means so as to insulate contact area means from one another and so as to permit said element to be bonded to a surface.

2. A method as in claim 1, wherein said indicia is a decorative ink layer and said method further includes the step of printing said ink layer on said substrate.

3. A method as in claim 2, wherein said ink layer is printed on the same side of said substrate as said contact area means and where the ink layer is printed on said substrate prior to the printing of said contact area means so that said contact area means are subsequently printed on said ink layer means.

4. A method as in claim 3, wherein said substrate is transparent and said indicia is visible therethrough.

* * * * *